US010276116B2

(12) United States Patent
Kim et al.

(10) Patent No.: US 10,276,116 B2
(45) Date of Patent: Apr. 30, 2019

(54) DIGITAL-TO-ANALOG CONVERTER, DRIVING INTEGRATED CIRCUIT, AND DISPLAY DEVICE

(71) Applicants: Samsung Display Co., LTD., Yongin-si, Gyeonggi-Do (KR); Sogang University Research Foundation, Seoul (KR)

(72) Inventors: Sang-Kuk Kim, Seoul (KR); Weon-Jun Choe, Hwaseong-si (KR); Moon-Sang Hwang, Seoul (KR); Tai-Ji An, Seoul (KR); Seung-Hoon Lee, Seoul (KR); Won-Kang Kim, Gunpo-si (KR); Jun-Sang Park, Seoul (KR)

(73) Assignee: Samsung Display Co., Ltd. (KR)

( * ) Notice: Subject to any disclaimer, the term of this patent is extended or adjusted under 35 U.S.C. 154(b) by 65 days.

(21) Appl. No.: 15/439,647

(22) Filed: Feb. 22, 2017

(65) Prior Publication Data

US 2017/0243553 A1 Aug. 24, 2017

(30) Foreign Application Priority Data

Feb. 23, 2016 (KR) ..... 10-2016-0020923

(51) Int. Cl.

| | |
|---|---|
| ***G09G 3/20*** | (2006.01) |
| ***G09G 3/36*** | (2006.01) |
| ***G09G 3/3258*** | (2016.01) |

(52) U.S. Cl.

CPC ..... *G09G 3/3648* (2013.01); *G09G 3/20* (2013.01); *G09G 3/3258* (2013.01); *G09G 2310/027* (2013.01); *G09G 2310/08* (2013.01)

(58) Field of Classification Search

CPC ..... G09G 3/3258; G09G 3/3648; G09G 3/20; G09G 2310/08; G09G 2310/027

See application file for complete search history.

(56) References Cited

U.S. PATENT DOCUMENTS

| | | | | |
|---|---|---|---|---|
| 2006/0146128 | A1* | 7/2006 | Ma | G09G 3/3611 348/89 |
| 2007/0241952 | A1* | 10/2007 | Kim | G09G 3/20 341/144 |
| 2008/0278420 | A1* | 11/2008 | Chang | G09G 3/2011 345/77 |
| 2010/0002019 | A1* | 1/2010 | Lee | G09G 3/3688 345/690 |

(Continued)

FOREIGN PATENT DOCUMENTS

| | | |
|---|---|---|
| KR | 10-0814255 B1 | 3/2008 |
| KR | 10-2011-0077348 A | 7/2011 |

*Primary Examiner* — Ariel A Balaoing

(74) *Attorney, Agent, or Firm* — Innovation Counsel LLP

(57) ABSTRACT

A digital-to-analog converter may include a converting unit and a distributing unit. The converting unit may generate a first analog signal set based on less-than-all bits of an image data set in a first period and may generate a second analog signal set based on all bits of the image data set in a second period. The all bits may include at least 2 bits. The distributing unit may include output terminals, may distribute the first analog signal set to the output terminals in a first sequence in the first period, and may distribute the second analog signal to the output terminals in a second sequence. The second sequence may be opposite to the first sequence.

20 Claims, 8 Drawing Sheets

(56) References Cited

U.S. PATENT DOCUMENTS

| | | | | |
|---|---|---|---|---|
| 2011/0156935 | A1* | 6/2011 | Zhao | H03M 1/685<br>341/98 |
| 2012/0262315 | A1 | 10/2012 | Kapusta et al. | |
| 2014/0055437 | A1* | 2/2014 | Ban | H03M 1/66<br>345/211 |
| 2015/0200681 | A1* | 7/2015 | Duggal | H03M 1/1038<br>341/118 |

* cited by examiner

DIGITAL-TO-ANALOG CONVERTER, DRIVING INTEGRATED CIRCUIT, AND DISPLAY DEVICE

CROSS-REFERENCE TO RELATED APPLICATION(S)

This application claims priority under 35 USC § 119 to Korean Patent Application No. 10-2016-0020923, filed on Feb. 23, 2016 in the Korean Intellectual Property Office (KIPO); the contents of the Korean Patent Application are incorporated herein in its entirety by reference.

BACKGROUND

1. Technical Field

The technical field may be related to a digital-to-analog converter for converting an image data set into a data signal set, a driving integrated circuit including the digital-to-analog converter, and a display device including the digital-to-analog converter.

2. Description of the Related Art

A display device includes a display panel and a data driver which provides a data signal set to a display panel by converting an image data set. The data driver includes a digital-to-analog converter (or a digital-to-analog converter) which sequentially generates analog signals (or data signals) based on digital signals (e.g., grayscale values) corresponding to pixels of a pixel column. The data driver further includes a buffer which transfers the analog signals to the pixels in the display panel.

SUMMARY

Some example embodiments may be related to a digital-to-analog converter providing analog signals to pixel columns with a satisfactory operation speed.

Some example embodiments may be related to a driving integrated circuit including the digital-to-analog converter.

Some example embodiments may be related to a display device including the driving integrated circuit.

According to example embodiments, a digital-to-analog converter may include a converting unit to generate a first analog signal based on at least a bit among N bits of image data in a first period and to generate a second analog signal based on the image data in the second period which is different from the first period, where N is an integer greater than or equal to 2; and a distributing unit to distribute the first analog signal to output terminals in a sequential order in the first period and to distribute the second analog signal to the output terminals in a reverse sequential order.

In example embodiments, the converting unit may include a first sub-converter to generate the first analog signal; a second sub-converter to generate the second analog signal; and a switching unit to distribute the first analog signal and the second analog signal to the distributing unit sequentially.

In example embodiments, the first sub-converter may generate first through Nth coarse voltages based on the at least a bit among the image data in a sequential order, and the second sub-converter may generate first through Nth fine voltages based on the image data in a reverse sequential order. In embodiments, the first analog signal may include the first through Nth coarse voltages, and the second analog signal may include the first through Nth fine voltages.

In example embodiments, a first driving frequency of the first sub-converter may be different from a second driving frequency of the second sub-converter.

In example embodiments, the switching unit may include a first converting switch electrically connecting an output stage of the first sub-converter and an input stage of the distributing unit in the first period; and a second converting switch electrically connecting an output stage of the second sub-converter and the input stage of the distributing unit in the second period.

In example embodiments, the output terminals of the distributing unit may include a first output terminal and a second output terminal. In embodiments, the distributing unit may distribute a first coarse voltage and a second coarse voltages included in the first analog signal to the first output terminal and the second output terminal sequentially in the first period and may distribute a second fine voltage and a first fine voltage included in the second analog signal to the second output terminal and the first output terminal sequentially in the second period.

In example embodiments, the digital-to-analog converter may further include a sampling unit to temporally store the first analog signal and the second analog signal which are output through the output terminals of the distributing unit in the first period and the second period.

In example embodiments, the digital-to-analog converter may further include a switching unit to electrically connect the sampling unit and an external component.

In example embodiments, the switching unit may electrically connect the sampling unit and the external component at a second time point between the first period and the second period.

In example embodiments, the converting unit may generate a third analog signal based on the image data in a third period, and the distributing unit may sequentially distribute the third analog signal to the output terminals in the third period, where the third period is different from the first period and the second period, and where a third waveform of the third analog signal is the same as a first waveform of the first analog signal.

According to example embodiments, a driving integrated circuit may include a digital-to-analog converting block to generate analog signals based on N bits of image data, where N is an integer greater than or equal to 2; and a buffer block including buffers and to stabilize the analog signals using the buffers and to output stabilized analog signal to an external component. In embodiments, the digital-to-analog converting block may include a converting unit to generate a first analog signal based on at least a bit among the image data in a first period and to generate a second analog signal based on the image data in a second period which is different from the first period; and a distributing unit to distribute the first analog signal to the buffers through the output terminals in a sequential order in the first period and to distribute the second analog signal to the buffers in a reverse sequential order in the second period.

In example embodiments, the converting unit may include a first sub-converter to generate the first analog signal; a second sub-converter to generate the second analog signal; and a switching unit to distribute the first analog signal and the second analog signal to the distributing unit sequentially.

In example embodiments, the first sub-converter may generate first through Nth coarse voltages based on the at least a bit among the image data in a sequential order, and the second sub-converter may generate first through Nth fine voltages based on the image data in a reverse sequential order, where the first analog signal includes the first through Nth coarse voltages, and where the second analog signal includes the first through Nth fine voltages.

In example embodiments, a first driving frequency of the first sub-converter may be different from a second driving frequency of the second sub-converter.

In example embodiments, the switching unit may include a first converting switch electrically connecting an output stage of the first sub-converter and an input stage of the distributing unit in the first period; and a second converting switch electrically connecting an output stage of the second sub-converter and the input stage of the distributing unit in the second period.

In example embodiments, the digital-to-analog converter may further include a sampling unit to temporally store the first analog signal and the second analog signal which are output through the output terminals of the distributing unit in the first period and the second period.

In example embodiments, the digital-to-analog converter may further include a switching unit to electrically connect the sampling unit and an external component.

In example embodiments, the switching unit may electrically connect the sampling unit and the external component at a second time point between the first period and the second period.

In example embodiments, the converting unit may generate a third analog signal based on the image data in a third period, and the distributing unit may sequentially distribute the third analog signal to the output terminals in the third period, where the third period is different from the first period and the second period, and where a third waveform of the third analog signal is the same as a first waveform of the first analog signal.

According to example embodiments, a display device may include a display panel including data lines and pixels electrically connected to the data lines, respectively; a driving integrated circuit to generate a data signal based on N bits of image data and to provide the data signal to the pixels through the data lines, where N is an integer greater than or equal to 2. In embodiments, the driving integrated circuit may include a digital-to-analog converting block to generate analog signals based on the image data; and a buffer block including buffers and to stabilize the analog signals using the buffers and to output stabilized analog signal to the display panel. In embodiments, the digital-to-analog converting block may include a converting unit to generate a first analog signal based on at least a bit among the image data in a first period and to generate a second analog signal based on the image data in a second period which is different from the first period; and a distributing unit to distribute the first analog signal to the buffers through the output terminals in a sequential order in the first period and to distribute the second analog signal to the buffers in a reverse sequential order in the second period, where the first analog signal and the second analog signal are included in the data signal.

Example embodiments may be related to a digital-to-analog converter. The digital-to-analog converter may include a converting unit and a distributing unit. The converting unit may generate a first analog signal set based on less-than-all bits of an image data set in a first period and may generate a second analog signal set based on all bits of the image data set in a second period. The all bits may include at least 2 bits. The distributing unit may include output terminals, may distribute the first analog signal set to the output terminals in (or according to) a first sequence in the first period, and may distribute the second analog signal to the output terminals in (or according to) a second sequence. The second sequence may be opposite to the first sequence.

The first period may (immediately) precede the second period.

A length of the second period may be unequal to a length of the first period.

The converting unit may include a first sub-converter, a second sub-converter, and a switching unit. The first sub-converter may generate the first analog signal set. The second sub-converter may generate the second analog signal set. The switching unit may provide the first analog signal set and the second analog signal set to the distributing unit sequentially.

The first sub-converter may generate first-type voltages based on the less-than-all bits of the image data set in the first sequence. The second sub-converter may generate second-type voltages based on the all bits of the image data set in the second sequence. The first analog signal set may include the first-type voltages. The second analog signal set may include the second-type voltages.

The first sub-converter may operate in a first frequency. The second sub-converter may operate in a second frequency. The first frequency may be unequal to (e.g., greater than) the second frequency.

The switching unit may include a first switch and a second switch. The first switch may electrically connect an output part of the first sub-converter to an input part of the distributing unit in the first period. The second switch may electrically connect an output part of the second sub-converter to the input part of the distributing unit in the second period.

The output terminals of the distributing unit may include a first output terminal and a second output terminal. The distributing unit may distribute a first first-type voltage and subsequently a second first-type voltage included in the first analog signal set to the first output terminal and the second output terminal respectively and sequentially in the first period. The distributing unit may distribute a second second-type voltage and subsequently a first second-type voltage included in the second analog signal set to the second output terminal and the first output terminal respectively and sequentially in the second period.

The digital-to-analog converter may include a sampling unit. The sampling unit may temporally store the first analog signal set and the second analog signal set (which are output through the output terminals of the distributing unit) in the first period and the second period.

The digital-to-analog converter may include a switching unit. The switching unit may electrically connect the sampling unit to an external component.

The switching unit may electrically connect the sampling unit to the external component at a time point between the first period and the second period, or at the end of the first period and/or at the start of the second period.

The converting unit may generate a third analog signal set based on the all bits of the image data set in a third period. The distributing unit may sequentially distribute the third analog signal set to the output terminals in the third period. A waveform of the third analog signal set may be substantially identical to a waveform of the first analog signal set. The second period may (immediately) precede the third period. A length of the third period may be unequal to at least one of a length of the first period and a length of the second period.

Some example embodiments may be related to a driving integrated circuit. The driving integrated circuit may include a digital-to-analog converting unit and a buffer unit. The digital-to-analog converting unit may have one or more of the above-described features and may provide analog signals. The buffer unit may include buffers, may stabilize the analog signals using the buffers, and may output stabilized analog signals to an external component.

Some example embodiments may be related to a display device. The display device may include a display panel and a driving integrated circuit. The display panel may include data lines and pixels electrically connected to the data lines, respectively. The driving integrated circuit may generate stabilized analog signals based on an image data set and may provide the stabilized analog signals to the pixels through the data lines. The digital-to-analog converting unit may have one or more of the above-described features and may provide analog signals that include a first analog signal set and a second analog signal set. The buffer unit may include buffers, may stabilize the analog signals using the buffers, and may output stabilized analog signals to the display panel.

According to embodiments, a digital-to-analog converter may minimize total time required for writing a data signal set onto pixels and may prevent a supply process of the data signal set from being significantly noticeable to a user. The advantages may be achieved by generating a second analog signal set representing all of an image data set and a first analog signal set representing at least a portion of the image data set, by providing the first analog signal set to a display panel (or to pixels) preliminarily, and by providing the second analog signal set to the display panel (or to the pixels) subsequently.

In embodiments, the digital-to-analog converter may have satisfactory driving stability and may minimize power consumption.

A driving integrated circuit and a display device according to embodiments may have satisfactory image displayed quality and/or may require minimum power consumption.

DESCRIPTION OF EMBODIMENTS

Embodiments are explained with reference to the accompanying drawings. Although the terms "first", "second", etc. may be used herein to describe various elements, these elements, should not be limited by these terms. These terms may be used to distinguish one element from another element. Thus, a first element discussed below may be termed a second element without departing from teachings of one or more embodiments. The description of an element as a "first" element may not require or imply the presence of a second element or other elements. The terms "first", "second", etc. may also be used herein to differentiate different categories or sets of elements. For conciseness, the terms "first", "second", etc. may represent "first-category (or first-set)", "second-category (or second-set)", etc., respectively. The term "signal" may mean "signal set" or "set of signals". The term "data" may mean "data set".

Figure 1:
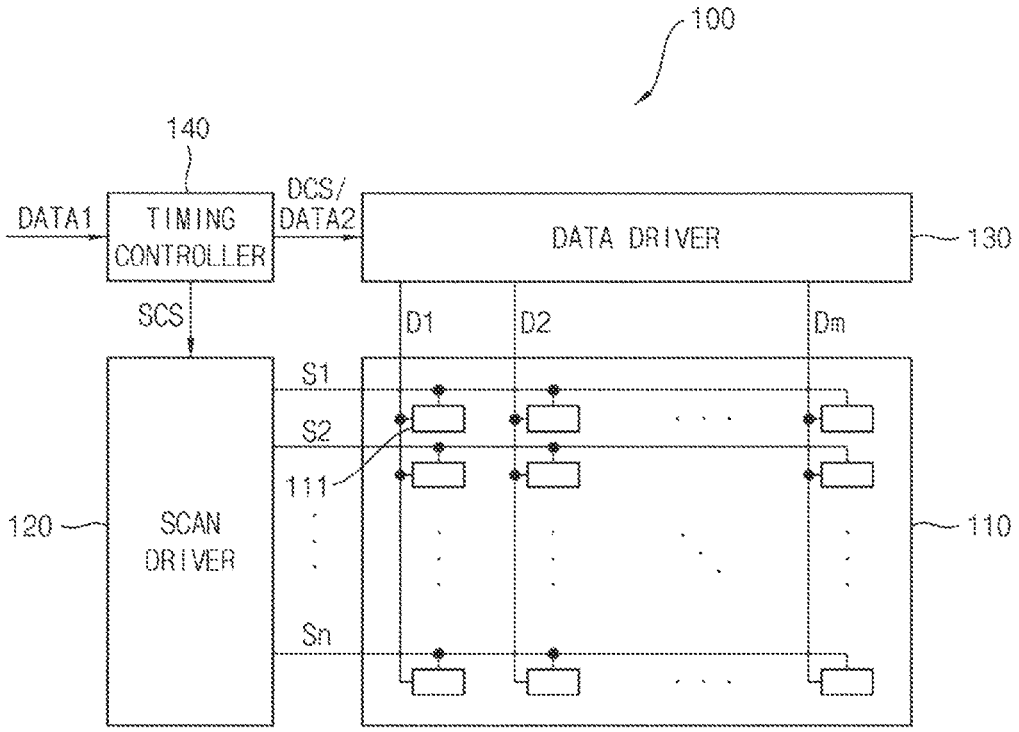
FIG. 1 is a block diagram illustrating a display device according to example embodiments.

FIG. 1 is a block diagram illustrating a display device according to example embodiments.

Referring to FIG. 1, the display device 100 may include a display panel 110, a scan driver 120, a data driver 130, and a timing controller 140. The display device 100 may display an image based on input data (e.g., first data DATA1) provided from an external component. For example, the display device 100 may be an organic light emitting display device.

The display panel 110 may include scan lines S1, S2, through Sn, data lines D1, D2, through Dm, and pixels 111, where each of m and n is a positive integer. The pixels 111 may be located in crossing-regions of the scan lines S1 through Sn and the data lines D1 through Dm. A pixel 111 may store a data signal (e.g., a data signal provided through one of the data lines D1 through Dm) in response to a scan signal (e.g., a scan signal provided through one of the scan lines S1 through Sn) and may emit light based on a stored data signal.

The scan driver 120 may generate the scan signal based on a scan driving control signal SCS. The scan driving control signal SCS may include a start pulse and clock signals, and the scan driver 120 may include shift registers sequentially generating the scan signal based on the start pulse and the clock signals.

The data driver 130 may generate the data signal in response to a data driving control signal DCS. The data driver 130 may convert image data of a digital format (e.g., second data DATA2) into the data signal of an analog format. The data driver 130 may generate a data signal based on predetermined grayscale voltages (or preset gamma voltages), where the grayscale voltages are provided from a gamma circuit to the data driver 130. The data driver 130 may provide the data signal to pixels included in a pixel column.

In some example embodiments, the data driver 130 may generate a first analog signal and a second analog signal based on the image data (e.g., the second data DATA2). The data driver 130 may generate the first analog signal using a subset of the image data and may generate the second analog signal using substantially all of the image data. For example, the data driver 130 may generate the first analog signal based on some bits (i.e., a subset) of the N bits of the image data (wherein the image data has a data format of N bits) and may generate the second analog signal based on all bits of the N bits of the image data. The first and second analog signals may be included in the data signal.

That is, the data driver 130 may generate the second analog signal having no loss of the image data and may generate the first analog signal having at least a portion of the image data. The data driver 130 may preliminarily provide the first analog signal to the pixel 111 and may subsequently provide the second analog signal to the pixel 111. In embodiments, a supply time length of the data signal (e.g., a time length required to write the data signal into the pixel 111) may be minimized, and a supply process of the data signal may be unnoticeable to the user. A configuration of the data driver 130 will be described in detail with reference to FIG. 2.

The scan driver 120 and the data driver 130 may be included in a driving integrated circuit.

The timing controller 140 may receive the image data (e.g., the first data DATA1) and input control signals (e.g., a horizontal synchronous signal, a vertical synchronous signal, and clock signals) from an external component and may generate a compensated image data (e.g., the second data DATA2) suitable to be displayed by the display panel 110. The timing controller 140 may control the scan driver 120 and the data driver 130. The timing controller 140 may generate the scan driving control signal SCS and the data driving control signal DCS based on the input control signals.

The display device 100 may further include a power supply. The power supply may generate a driving voltage to drive the display device 100 and may provide the driving voltage to the display panel (or the pixels 111). Here, the driving voltage may be a power voltage required to drive the pixels 111, for example, the driving voltage may include a first power voltage ELVDD and a second power voltage ELVSS. The first power voltage ELVDD may be greater than the second power voltage ELVSS.

Figure 2:
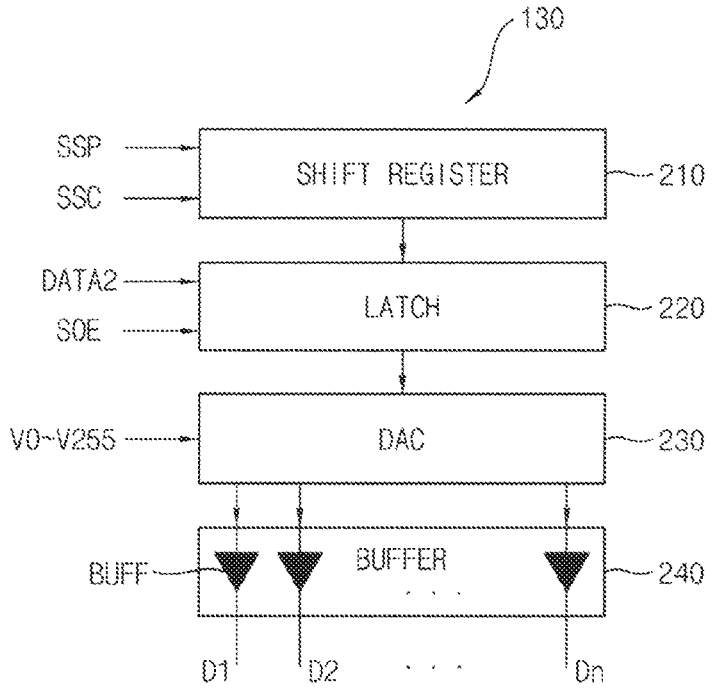
FIG. 2 is a block diagram illustrating an example of a data driver included in the display device illustrated in FIG. 1.

FIG. 2 is a block diagram illustrating an example of a data driver included in the display device illustrated in FIG. 1.

Referring to FIG. 2, the data driver 130 may include a shifting register block 210, a latch block 220, a digital-to-analog converter block 230 (or DAC 230), and a buffer block 240.

As described with reference to FIG. 1, the data driver 130 may receive the second data DATA2 and the data driving control signal DCS from the timing controller 140. In embodiments, the data driving control signal DCS may include a source start pulse SSP, a source shift clock SSC (or a source shift clock signal), and a source output enable SOE (or a source output enable signal). The data driver 130 may receive grayscale voltages V0 through V255 from a gamma circuit.

The shift register block 210 may sequentially generate sampling signals by shifting the source start pulse SSP based on the source shift clock SSC in a horizontal time unit 1H. For example, the shift register block 210 may include shift registers.

The latch block 220 may sequentially latch the second data DATA2 (e.g., image data provided from the timing controller 140) in response to the sampling signals (e.g., sampling signals generated by the shift register block 210).

The digital-to-analog converting block 230 may generate analog voltages (or data voltages/signals) corresponding to the second data DATA2 provided from the latch block 220 and may provide the analog voltages to the buffer block 240. For example, the digital-to-analog converting block 230 may receive the gamma voltages V0 through V255 from the gamma circuit (or a grayscale voltages generating block) and may generate the analog voltages corresponding to the second data DATA2. The digital-to-analog converting block 230 may include digital-to-analog converters.

The buffer block 240 may provide the analog voltages (or data voltages) to the data lines D1 through Dm. The buffer block 240 may include buffers BUFF (or source channel buffers), and each of the buffers BUFF may be an operational amplifier.

Figure 3:
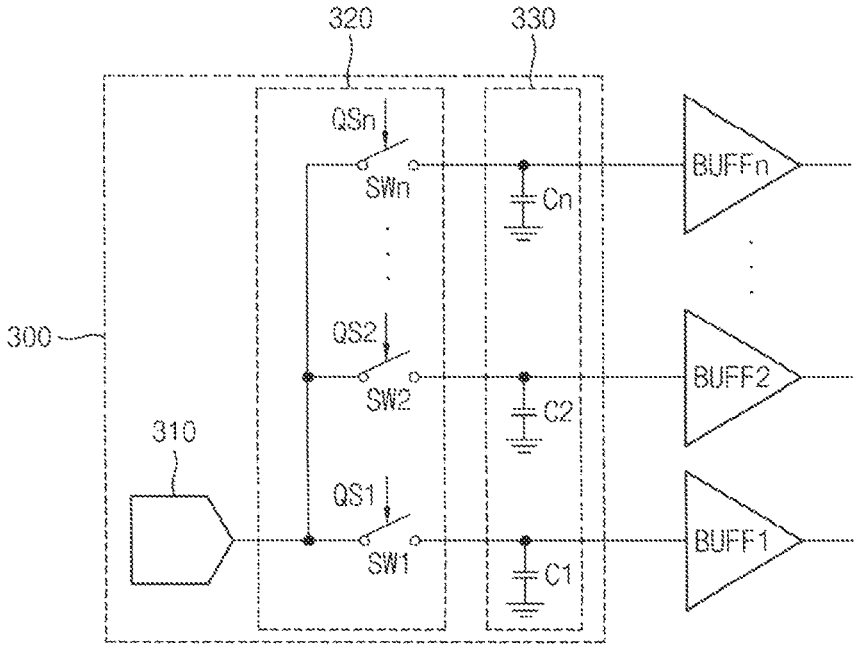
FIG. 3 is a diagram (e.g., a circuit diagram) illustrating an example of a digital-to-analog converting block included in the data driver illustrated in FIG. 2.
Figure 4:
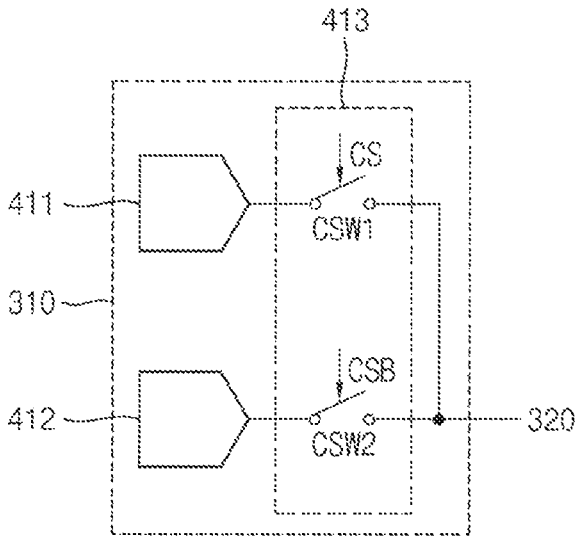
FIG. 4 is a diagram illustrating an example of a converter included in the digital-to-analog converting block illustrated in FIG. 3.
Figure 5:
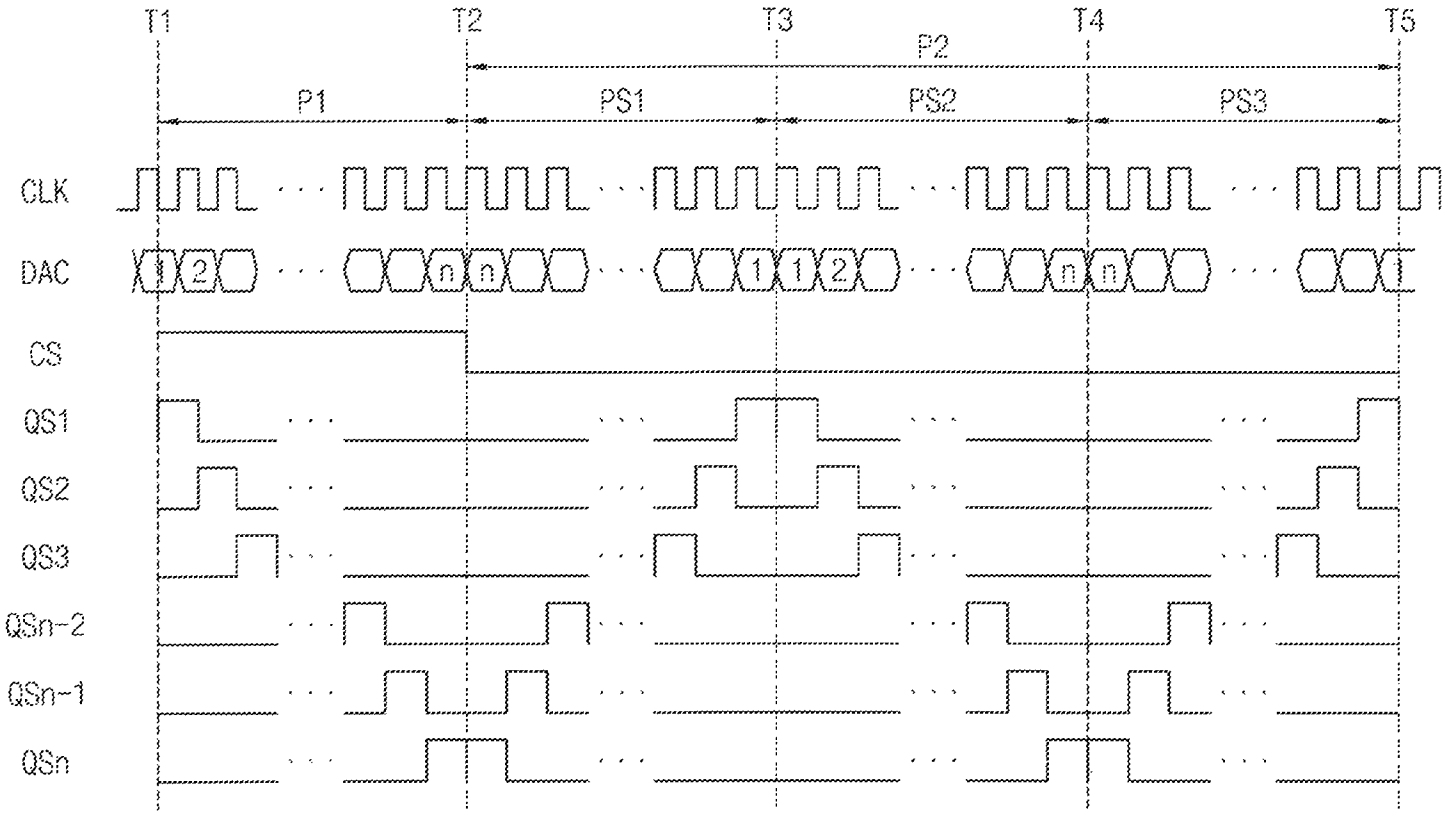
FIG. 5 is a waveform diagram illustrating an example of an operation of the digital-to-analog converting block illustrated in FIG. 3.
Figure 6:
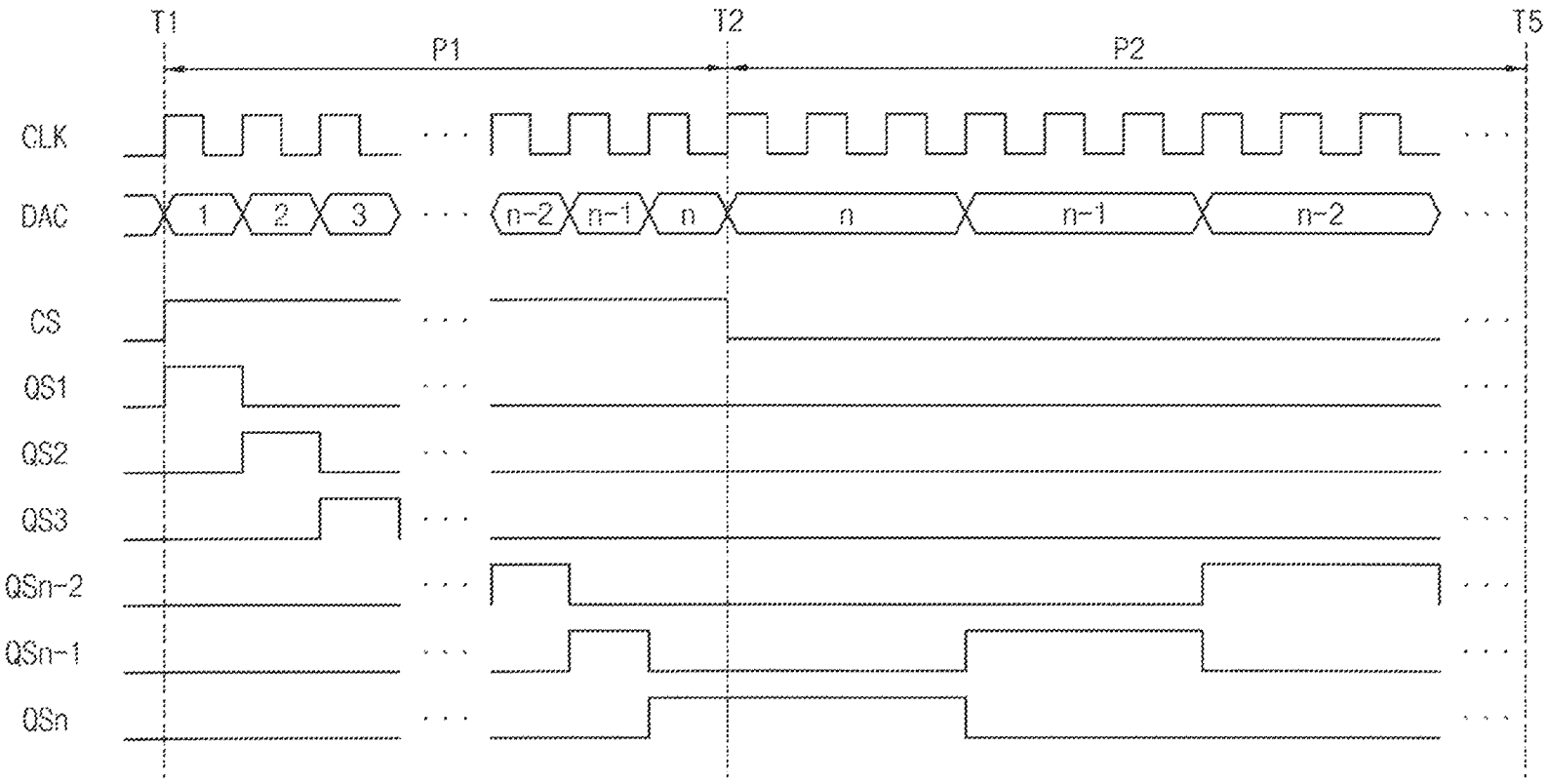
FIG. 6 is a waveform diagram illustrating an example of an operation of the digital-to-analog converting block illustrated in FIG. 3.

FIG. 3 is a diagram (e.g., a circuit diagram) illustrating an example of a digital-to-analog converting block included in the data driver illustrated in FIG. 2. FIG. 4 is a diagram illustrating an example of a converter included in the digital-to-analog converting block illustrated in FIG. 3. FIG. 5 is a waveform diagram illustrating an example of an operation of the digital-to-analog converting block illustrated in FIG. 3. FIG. 6 is a waveform diagram illustrating an example of an operation of the digital-to-analog converting block illustrated in FIG. 3.

Referring to FIGS. 3 and 5, the digital-to-analog converting block 300 may include output terminals and may generate the first analog signal (or a coarse signal) during a first period P1 and may distribute (or provide) the first analog signal to the output terminals (or to a first buffer BUFF1, a second buffer BUFF2, through an nth buffer BUFFn of the buffer block 240) sequentially (or in a sequential order). In embodiments, the digital-to-analog converting block 300 may generate the second analog signal (or a fine signal) during a second period P2 and may distribute (or provide) the second analog signal to the output terminals (or to the first buffer BUFF1 through the nth buffer BUFFn of the buffer block 240) in a reverse sequential order that is reverse/opposite to the sequential order. In embodiments, the second period P2 may be different from the first period P1, and the f periods P1 and P2 may be included in a horizontal time period 1H. In embodiments, the image data DATA2 may include grayscale values corresponding to pixels of pixel columns (e.g., pixel columns electrically connected to the data lines D1 through Dm, respectively, illustrated in FIG. 1), and the first and second analog signals may include analog voltages corresponding to the pixel columns.

As illustrated in FIG. 3, the digital-to-analog converter 300 may include a converting unit 310 (or a converter), a distributing unit 320 (or a distributor), and a sampling unit 330 (or a sampler).

The converting unit 310 may generate the first analog signal based on at least a bit (i.e., a subset) of the N bits of the image data (e.g., the second data DATA2) during the first period P1 and may generate the second analog signal based on all of the N bits of the image data during the second period P2, where N is an integer greater than or equal to 2.

For example, the converting unit 310 may generate the first analog signal based on higher-order three bits among the eight bits of the second data DATA2 during the first period P1 and may generate the second analog signal based on the eight bits of the eight bits of the second data DATA2 during the second period P2. For example, the converting unit 310 may generate the first analog signal based on the eight bits of the eight bits of the second data DATA2 during the first period P1 and may generate the second analog signal based on the eight bits of the eight bits of the second data DATA2 during the second period P2.

In some example embodiments, the converting unit 310 may generate first through Nth coarse voltages based on at least a bit (i.e., a subset) of the N bits of the image data (e.g., the second data DATA2) in a sequential order during the first period P1 and may generate first through Nth fine voltages based on the N bits of the image data in a reverse sequential order that is reverse/opposite to the sequential order during the second period P2. In embodiments, the first through Nth coarse voltages may be included in the first analog signal, and the first through Nth fine voltages may be included in the second analog signal.

Referring to FIGS. 5 and 6, the converting unit 310 may generate the first analog signal including a first coarse voltage and a second coarse voltage through an Nth coarse voltage in a sequential order during the first period P1 and may generate the second analog signal including an Nth fine voltage through a second fine voltage and a first fine voltage in a sequential order in the second period P2 (or a first sub-period PS1 included in the second period P2).

In some example embodiments, the converting unit 310 may change a driving speed (or an operation speed).

Referring to FIG. 5, a first driving speed of the converting unit 310 in the first period P1 may be higher or faster than a second driving speed of the converting unit 310 in the second period P2. That is, a first driving frequency of the converting unit 310 in the first period P1 may be greater than a second driving frequency of the converting unit 310 in the second period P2.

For example, in the first period P1, the converting unit 310 may generate the first analog signal based on three bits among eight bits of the second data DATA2 and may distribute the first analog signal to twenty four buffers. In embodiments, the first driving speed may be set as 25 megahertz (MHz), and the first period P1 may be set as 0.96 microseconds (μs) considering a delay of the first analog signal corresponding to the three bits.

In embodiments, the in the second period P2, the converting unit 310 may generate the second analog signal based on the eight bits of the second data DATA2 and may distribute the second analog signal to the twenty four buffers. In embodiments, the second driving speed may be set as 8.3 MHz, and the second period P2 may be set as 2.88 μs considering a delay of the second analog signal corresponding to the eight bits.

Therefore, the converting unit 310 may operate in the second driving speed lower than the first driving speed and may require lower power consumption in comparison with a converting unit having only the first driving speed.

Similarly, a driving speed of the distributing unit 320 may be lowered corresponding to the lowered driving speed of the converting unit 310 (e.g., the first and second driving speed), and power consumption of the distributing unit 320 may be reduced.

In some example embodiments, the converting unit 310 may include a first sub-converter 411, a second sub-converter 412, and a switching unit 413 (or a switching circuit).

Referring to FIG. 4, the first sub-converter 411 may generate the first analog signal based on at least a bit among N bits of the image data (e.g., the second data DATA2) during the first period P1. For example, the first sub-converter 411 may sequentially generate the first through Nth coarse voltages based on three bits among the eight bits of the image data.

The second sub-converter 412 may generated the second analog signal based on the N bits of the image data in the second period P2. For example, the second sub-converter 412 may generate the first through Nth fine voltages based on the eight bits of the image data in a reverse sequential order that is reverse/opposite to the sequential order.

In some example embodiments, each of the first sub-converter 411 and the second sub-converter 412 may be a digital-to-analog converter. That is, the converting unit 310 may include digital-to-analog converters.

In some example embodiments, a first driving frequency (or a first operation frequency) of the first sub-converter 411 may be different from a second driving frequency (or a second operation frequency) of the second sub-converter 412. For example, the first driving frequency of the first sub-converter 411 may be greater than or higher than the second driving frequency of the second sub-converter 412. In embodiments, the digital-to-analog converting block 400 may reduce power consumption by decreasing a driving speed of the second sub-converter 412.

The switching unit 413 may sequentially transfer the first analog signal and the second analog signal to the distributing unit 320. The switching unit 413 may include a first converting switch CSW1 and a second converting switch CSW2.

The first converting switch CSW1 may electrically connect an output stage of the first sub-converter 411 and the distributing unit 320 (or an input stage of the distributing unit 320) in response to a first converting switch control signal CS. As illustrated in FIG. 5, the first converting switch control signal CS may have a logic high level (or a turn-on voltage) in the first period P1, and the first converting switch CSW1 may be turned on in the first period P1.

The second converting switch CSW2 may electrically connect an output stage of the second sub-converter 412 and the distributing unit 320 (or an input stage of the distributing unit 320) in response to a second converting switch control signal CSB. In embodiments, the second converting switch control signal CSB may be reverse to the first converting switch control signal CS. As illustrated in FIG. 5, the first converting switch control signal CS may have a logic low level (or a turn-off voltage) in the second period P1, and therefore the second converting switch control signal CSB may have the logic high level (or a turn-on voltage) in the second period P2. In embodiments, the second converting switch CSW2 may be turned on in the second period P2.

As described with reference to FIG. 4, the digital-to-analog converting block 300 may include digital-to-analog converters having different driving frequencies. In embodiments, the digital-to-analog converting block 300 may have satisfactory driving stability. In embodiments, an average driving speed (or an average operation speed) of the digital-to-analog converters may be substantially low. Therefore, the digital-to-analog converter 300 may minimize power consumption.

Referring again to FIG. 3, the distributing unit 320 may distribute the first analog signal to output terminals (or to a first buffer BUFF1 through an nth buffer BUFFn included in the buffer block 240) in a sequential order during the first period P1 and may distribute the second analog signal to output terminals in a reverse sequential order that is reverse/opposite to the sequential order during the second period P2. For example, the distributing unit 320 may be a 1-to-n de-multiplexer (e.g., a de-multiplexer having one input and n outputs).

In some example embodiments, the distributing unit 320 may include first through nth switches SW1, SW2, through SWn. The switches SW1, SW2, through SWn may be sequentially turned on in response to switch control signals QS1, QS2, through QSn-2, QSn-1, QSn and may sequentially connect the converting unit 310 and the buffers BUFF1, BUFF2, through BUFFn.

The sampling unit 330 may temporally store the first analog signal and/or the second analog signal which are output through the output terminals of the distributing unit 320. The sampling unit 330 may include first, second, through nth capacitors C1, C2, through Cn, may respectively store the first analog signal (and/or the second analog signal) which are distributed by the distributing unit 320, and may respectively provide the first analog signal (and/or the second analog signal) to the buffers BUFF1 through BUFFn.

Referring to FIG. 5, the converting unit 310 may sequentially generate the first analog signal (including the first through nth coarse voltages) in the first period P1. That is, the converting unit 310 may generate the first coarse voltage at a first time point T1 and may sequentially generate the second coarse voltage through the nth coarse voltage with a certain time interval (or in response to a clock signal CLK) until a second time point T2. In embodiments, the certain time interval may be determined based on a driving speed of the converting unit 310.

In embodiments, the first through nth switches SW1 through SWn included in the distributing unit 320 may be sequentially turned on in response to the switch control signals QS1 through QSn. For example, the first through nth switches SW1 through SWn may be sequentially turned on in response to the switch control signals QS1 through QSn having a logic high level (or a turn-on voltage) from the first time point T1 to the second time point T2. Therefore, the first through nth coarse voltages may be sequentially provided to the first, second, through nth capacitors C1, C2, through Cn (or to the first, second, through nth buffers BUFF1, BUFF2, through BUFFn).

After this, the converting unit 310 may sequentially generate the second analog signal (including the first through nth fine voltages) during the second period P2 in an order/sequence that is opposite/reverse to the order/sequence followed in the first period P1. That is, the converting unit 310 may generate the nth fine voltage at the second time point T2 and may generate an n−1th fine voltage through the first fine voltage with a certain time interval until a third time point T3 (or until a fifth time point T5).

In embodiments, the first through nth switches SW1 through SWn included in the distributing unit 320 may be turned on in response to the switch control signals QS1 through QSn in a reverse sequential order. For example, the first through nth switches SW1 through SWn may be turned on in a reverse sequential order in response to the switch control signals QS1 through QSn having a logic high level (or a turn-on voltage) from the second time point T1 to the third time point T3. Therefore, the first through nth fine voltages may be provided to the first through nth capacitors C1 through Cn (or to the first through nth buffers BUFF1 through BUFFn) in a reverse sequential order.

In some example embodiments, the converting unit 310 may generate a third analog signal based on the image data (e.g., the second data DATA2) during a third period, and the distributing unit 320 may distribute the third analog signal to the output terminals (or to the first through nth buffers BUFF1 through BUFFn) sequentially. In embodiments, the third period may be different from the first period P1 and the second period P2, and a third waveform of the third analog signal may be substantially the same as or similar to a first waveform of the first analog signal.

As illustrated in FIG. 5, the converting unit 310 may sequentially regenerate the first through nth fine voltages based on the image data (e.g., the second data DATA2) during a second sub-period PS2. That is, the converting unit 310 may generate the first fine voltage at a third time point T3 and may sequentially generate a second fine voltage through the nth fine voltage with a certain time interval until a fourth time point T4.

In embodiments, the first through nth switches SW1 through SWn included in the distributing unit 320 may be sequentially turned on in response to the switch control signals QS1 through QSn. For example, the first through nth switches SW1 through SWn may be sequentially turned on in response to the switch control signals QS1 through QSn having a logic high level (or a turn-on voltage) from the third time point T3 to the fourth time point T4. Therefore, the first through nth fine voltages may be sequentially provided to the first through nth capacitors C1 through Cn (or to the first through nth buffers BUFF1 through BUFFn).

As described with reference to FIG. 5, the digital-to-analog converting block 300 may generate the first analog signal (or a coarse signal) based on some bits of the second data DATA2 (or the image data) and may sequentially provide the first analog signal to the buffer block 240 (or to the buffers BUFF1 through BUFFn). In embodiments, the digital-to-analog converting block 300 may generate the second analog signal (or a fine signal) based on the second data DATA2 and may provide the second analog signal to the buffer block 240 (or to the buffers BUFF1 through BUFFn) in a reverse sequential order.

In embodiments, the display device 100 (or the data driver 130) including the digital-to-analog converting block 300 may preliminarily write the first analog signal (or a coarse signal) into pixels using a first substantially short time period (e.g., 0.96 μs) and may subsequently write the second analog signal into the pixels using a second substantially short time period (e.g., 2.88 μs). Therefore, a writing process of data signals (the first and second analog signals) may be substantially unnoticeable to the user, and a writing time for the data signals may be sufficiently minimized.

Figure 7:
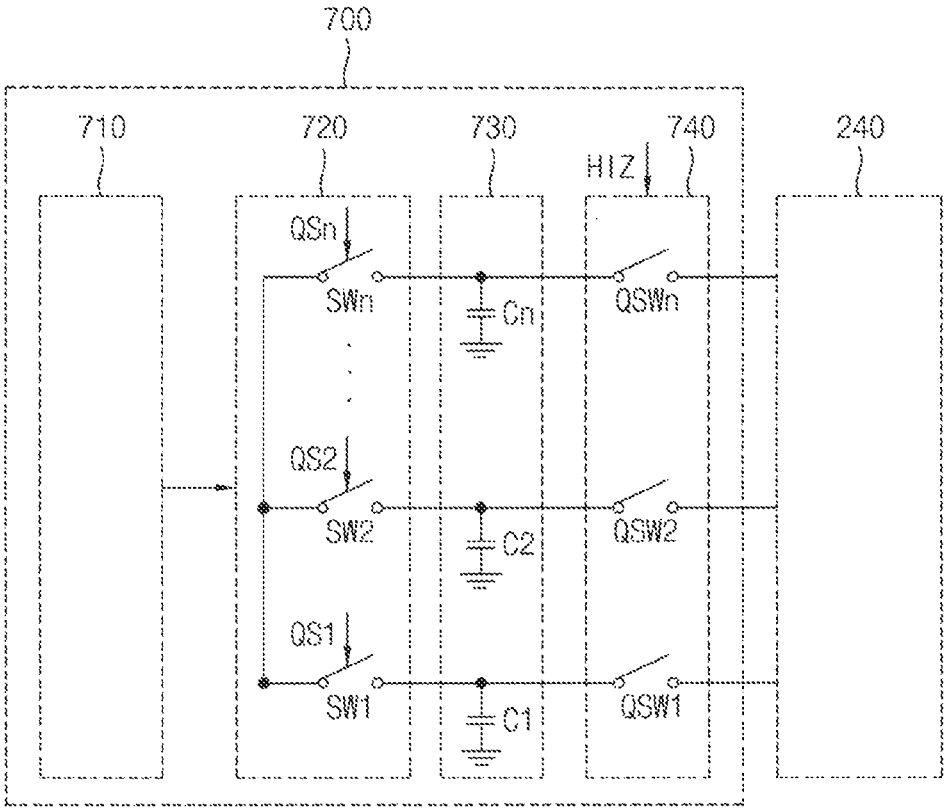
FIG. 7 is a diagram illustrating an example of a digital-to-analog converting block included in the data driver of FIG. 2.
Figure 8:
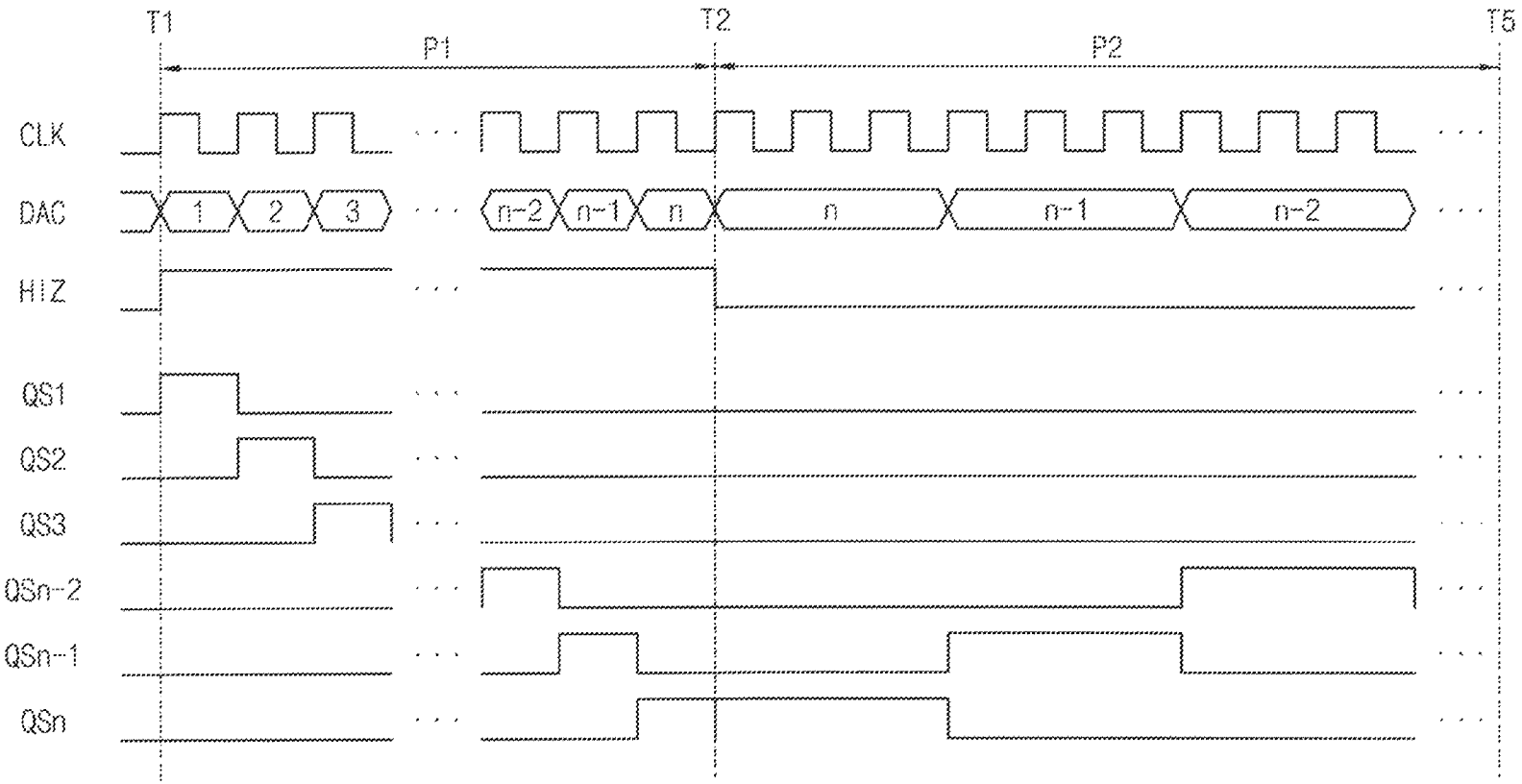
FIG. 8 is a waveform diagram illustrating an example of an operation of the digital-to-analog converting block illustrated FIG. 7.

FIG. 7 is a diagram illustrating an example of a digital-to-analog converting block included in the data driver illustrated in FIG. 2. FIG. 8 is a waveform diagram illustrating an example of an operation of the digital-to-analog converting block illustrated in FIG. 7.

Referring to FIGS. 7 and 8, the digital-to-analog converting block 700 may include a converting unit 710, a distributing unit 720, a sampling unit 730, and a switching unit 740. The converting unit 710, the distributing unit 720, and the sampling unit 730 may be as analogous to or substantially identical to the converting unit 310, the distributing unit 320, and the sampling unit 330 described with reference to FIG. 3. Therefore, description may not be repeated.

The switching unit 740 may electrically connect the sampling unit 730 (or output terminals of the distributing unit 720) and an external component (e.g., the buffer block 240 illustrated in FIG. 2). The switching unit 740 may include output switches OSW1, QSW2, through OSWn corresponding to capacitors C1, C2, through Cn included in the sampling unit 730 (and/or corresponding to buffers BUFF1, BUFF2, through BUFFn included in the buffer block 240). The output switches OSW1 through OSWn may be turned on in response to output switch control signal HIZ.

In some example embodiments, the switching unit 740 may electrically connect the sampling unit 730 (or the output terminals of the distributing unit 720) and the external component (e.g., the buffer block 240) at a second time point T2 between the first period P1 and the second period P2.

As illustrated in FIG. 8, the output switch control signal HIZ may have a logic high level (or a turn-off voltage) in the first period P1 and may have a logic low level (or a turn-on voltage) in the second period P2. In embodiments, the output switches OSW1 through OSWn may be turned on at the second time point T2 at which the output switch control signal HIZ is changed. In embodiments, the first analog signal stored in the sampling unit 730 may be provided to the buffer block 240 simultaneously. Therefore, the display device 100 (or the data driver 130) may simultaneously provide the first analog signal to the pixels at the second time point T2 and may provide the second analog signal to the pixels sequentially.

Therefore, the display device 100 may effectively prevent writing of a data signal from being noticeable to a user.

Figure 9:
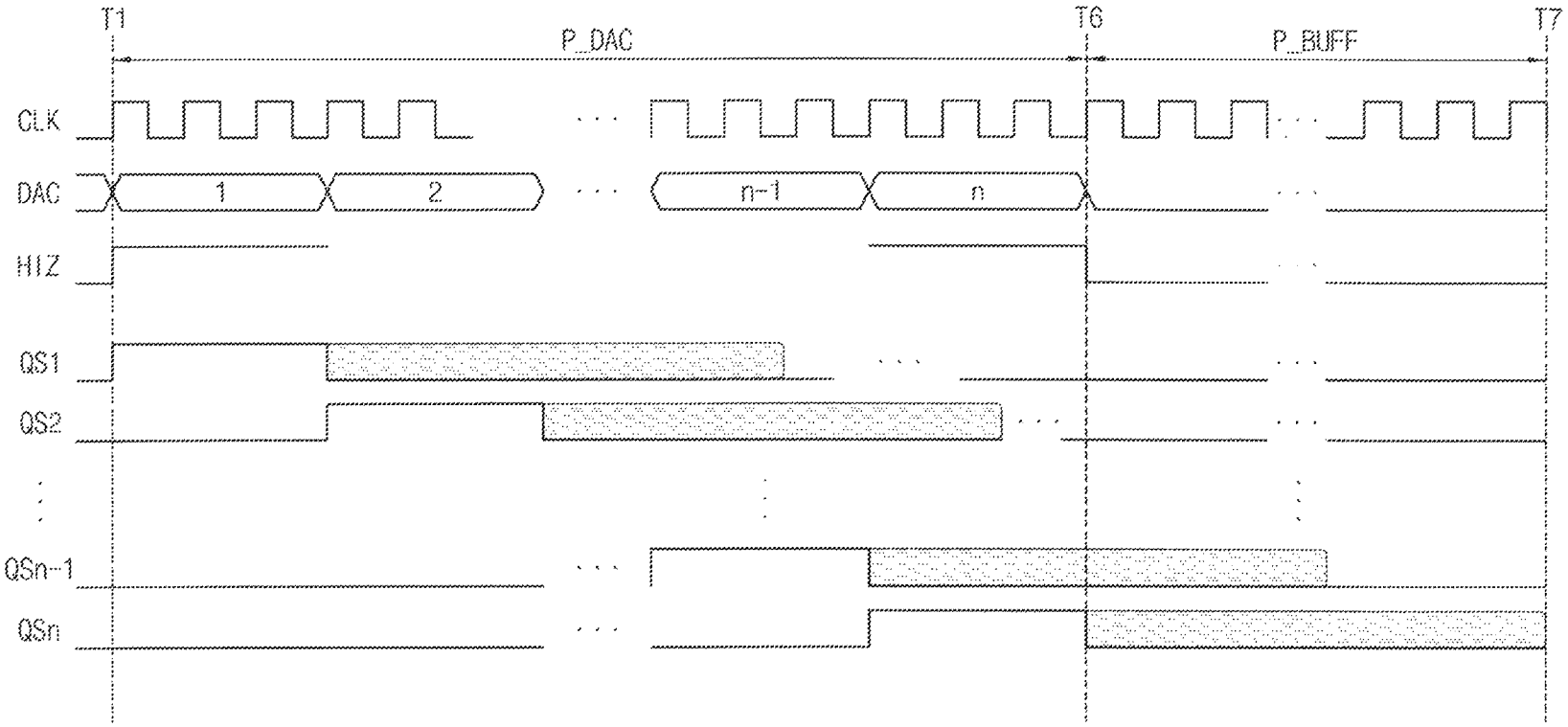
FIG. 9 is a waveform diagram illustrating a comparative example of an operation of the digital-to-analog converting block of FIG. 7.

FIG. 9 is a waveform diagram illustrating a comparative example of an operation of the digital-to-analog converting block illustrated in FIG. 7.

Referring to FIGS. 7 and 9, the digital-to-analog converting block 700 may generate a data signal based on the image data (e.g., the second data DATA2) in a first comparative period P_DAC and may sequentially distribute the data signal to the sampling unit 730. That is, the converting unit 710 may generate a first fine voltage at the first time point T1 and may sequentially generate a second fine voltage through nth fine voltage with a certain time interval (or in response to a clock signal CLK) until a sixth time point T6.

The output switch control signal HIZ may have a logic high level (or a turn-off voltage) in the first comparative period P_DAC. In embodiments, the first fine voltage through the nth fine voltage may be temporally stored in the capacitors C1 through Cn of the sampling unit 730. When the first through nth fine voltages sequentially generated are provided to an external component (e.g., to the display panel 110) sequentially, a sequential supply of the first through nth fine voltage may be noticeable to a user. Therefore, the digital-to-analog converting block 700 may not provide (or may delay a supply of) the first through nth fine voltages to the buffer block 240 until the nth fine voltage is finally generated.

At the sixth time point T6, the output switch control signal HIZ may be changed to have a logic low level. In embodiments, the first through nth fine voltages may be simultaneously provided to the buffer block 240.

In a second comparative period P_BUFF, the first through nth fine voltages may be stabilized or settled in the buffer block 240. The second comparative period P_BUFF may be determined or set considering a delay of the first through nth fine voltages (or a delay of the data signal). For example, the second comparative period P_BUFF may be 1.0 μs.

At a seventh time point T7, the data signal may be provided to an external component (e.g., the display panel 110).

The digital-to-analog converting block 700 according to an comparative example with reference to FIG. 9 may distribute the data signal corresponding to the buffer block 240 (or corresponding to the buffers BUFF1 through BUFFn of the buffer block 240), may store distributed signals into the sampling unit 730, and may provide stored signal (e.g., the first through nth fine voltages) to the pixels simultaneously. In embodiments, a supply of the data signal may not be noticeable to a user. However, the display device 100 may require a first time for distributing the data signal, a second time for settling the data signal to the buffer block 240 (or to the buffers BUFF1 through BUFFn), a third time for writing the data signal to the pixels, etc.

The digital-to-analog converting block 300 (and/or the digital-to-analog converting block 700) according to example embodiments may output the first analog signal and the second analog signal in a sequential order and/or in a reverse sequential order. Therefore, only a short period of time for distributing the first analog signal and the second analog signal may be required.

That is, the digital-to-analog converting block 300 (and/or the digital-to-analog converting block 700) according to example embodiments may have sufficient driving time. In embodiments, power consumption may be minimized.

Embodiments may be applied to various types of display devices (e.g., organic light emitting display devices, liquid crystal display devices, etc.). Embodiments may be applied to one or more of a television, a computer monitor, a laptop, a digital camera, a cellular phone, a smart phone, a personal digital assistant (PDA), a portable multimedia player (PMP), an MP3 player, a navigation system, a video phone, etc.

Although a few example embodiments have been described, those skilled in the art will readily appreciate that many modifications are possible in the example embodiments without materially departing from the novel teachings and advantages of the example embodiments. All such modifications are intended to be included within the scope defined in the claims. In the claims, means-plus-function clauses are intended to cover the structures described herein as performing the recited function and not only structural equivalents but also equivalent structures.

What is claimed is:

1. A digital-to-analog converter comprising:

a converting unit configured to generate a first analog signal set based on less-than-all bits of an image data set in a first period and configured to generate a second analog signal set based on all bits of the image data set in a second period, where the all bits include at least 2 bits; and a distributing unit comprising output terminals and configured to distribute the first analog signal set to the output terminals in a first sequence in the first period and configured to distribute the second analog signal set to the output terminals in a second sequence, wherein the second sequence is opposite to the first sequence.

2. The digital-to-analog converter of claim 1, wherein the converting unit includes:

a first sub-converter configured to generate the first analog signal set;

a second sub-converter configured to generate the second analog signal set; and a switching unit configured to provide the first analog signal set and the second analog signal set to the distributing unit sequentially.

3. The digital-to-analog converter of claim 2, wherein the first sub-converter generates first-type voltages based on the less-than-all bits of the image data set in the first sequence, wherein the second sub-converter generates second-type voltages based on the all bits of the image data set in the second sequence, wherein the first analog signal set includes the first-type voltages, and wherein the second analog signal set includes the second-type voltages.

4. The digital-to-analog converter of claim 2, wherein the first sub-converter operates in a first frequency, wherein the second sub-converter operates in a second frequency, and wherein the first frequency is unequal to the second frequency.

5. The digital-to-analog converter of claim 2, wherein the switching unit includes:

a first switch electrically connecting an output part of the first sub-converter to an input part of the distributing unit in the first period; and a second switch electrically connecting an output part of the second sub-converter to the input part of the distributing unit in the second period.

6. The digital-to-analog converter of claim 1, wherein the output terminals of the distributing unit includes a first output terminal and a second output terminal, and wherein the distributing unit distributes a first first-type voltage and a second first-type voltage included in the first analog signal set to the first output terminal and the second output terminal respectively and sequentially in the first period and distributes a second second-type voltage and a first second-type voltage included in the second analog signal set to the second output terminal and the first output terminal respectively and sequentially in the second period.

7. The digital-to-analog converter of claim 1, further comprising:

a sampling unit configured to temporally store the first analog signal set and the second analog signal set received from the output terminals of the distributing unit.

8. The digital-to-analog converter of claim 7, further comprising:

a switching unit configured to electrically connect the sampling unit to an external component.

9. The digital-to-analog converter of claim 8, wherein the switching unit electrically connects the sampling unit to the external component at a time point between the first period and the second period.

10. The digital-to-analog converter of claim 1, wherein the converting unit generates a third analog signal set based on the all bits of the image data set in a third period, wherein the distributing unit sequentially distributes the third analog signal set to the output terminals in the third period, and wherein a waveform of the third analog signal set is identical to a waveform of the first analog signal set.

11. A driving integrated circuit comprising:

a digital-to-analog converting unit configured to generate analog signals based on an image data set; and a buffer unit including buffers and configured to stabilize the analog signals using the buffers and to output stabilized analog signals to an external component, wherein the digital-to-analog converting unit includes:

a converting unit configured to generate a first analog signal set based on less-than-all bits of the image data set in a first period and configured to generate a second analog signal set based on all bits of the image data set in a second period, which follows the first period, wherein the all bits include at least 2 bits; and a distributing unit comprising output terminals and configured to distribute the first analog signal set to the buffers through the output terminals in a first sequence in the first period and to distribute the second analog signal set to the buffers in a second sequence in the second period, wherein the second sequence is opposite to the first sequence.

12. The driving integrated circuit of claim 11, wherein the converting unit includes:

a first sub-converter configured to generate the first analog signal set;

a second sub-converter configured to generate the second analog signal set; and a switching unit configured to provide the first analog signal set and the second analog signal set to the distributing unit sequentially.

13. The driving integrated circuit of claim 12, wherein the first sub-converter generates first-type voltages based on the less-than-all bits of the image data set in the first sequence, wherein the second sub-converter generates second-type voltages based on the all bits the image data set in the second sequence, wherein the first analog signal set includes the first-type voltages, and wherein the second analog signal set includes the second-type voltages.

14. The driving integrated circuit of claim 12, wherein the first sub-converter operates in a first frequency, wherein the second sub-converter operates in a second frequency, and wherein the first frequency is greater than the second frequency.

15. The driving integrated circuit of claim 12, wherein the switching unit includes:

a first converting switch electrically connecting an output part of the first sub-converter to an input part of the distributing unit in the first period; and a second converting switch electrically connecting an output part of the second sub-converter to the input part of the distributing unit in the second period.

16. The driving integrated circuit of claim 11, wherein the digital-to-analog converter further includes:

a sampling unit configured to temporally store the first analog signal set and the second analog signal set received from the output terminals of the distributing unit.

17. The driving integrated circuit of claim 16, wherein the digital-to-analog converter further includes:

a switching unit to electrically connect the sampling unit to an external component.

18. The driving integrated circuit of claim 17, wherein the switching unit electrically connects the sampling unit to the external component at a second time point between the first period and the second period.

19. The driving integrated circuit of claim 11, wherein the converting unit generates a third analog signal set based on all bits of the image data set in a third period, wherein the distributing unit sequentially distributes the third analog signal set to the output terminals in the third period, and wherein a waveform of the third analog signal set is identical to a waveform of the first analog signal set.

20. A display device comprising:

a display panel including data lines and pixels electrically connected to the data lines, respectively;

a driving integrated circuit configured to generate stabilized analog signals based on an image data set and to provide the stabilized analog signals to the pixels through the data lines, wherein the driving integrated circuit includes:

a digital-to-analog converting unit configured to generate analog signals based on the image data set; and a buffer unit including buffers and configured to stabilize the analog signals using the buffers and to output the stabilized analog signal to the display panel, wherein the digital-to-analog converting unit includes:

a converting unit configured to generate a first analog signal set based on less-than-all bits of the image data set in a first period and to generate a second analog signal set based on all bits of the image data set in a second period, wherein the all bits include at least 2 bits; and a distributing unit comprising output terminals and configured to distribute the first analog signal set to the buffers through the output terminals in a first sequence in the first period and to distribute the second analog signal to the buffers in a second sequence in the second period, wherein the second sequence is opposite to the first sequence, and wherein the analog signals include the first analog signal set and the second analog signal set.

* * * * *